US006557939B1

(12) United States Patent
Bräuning

(10) Patent No.: US 6,557,939 B1
(45) Date of Patent: May 6, 2003

(54) ADJUSTMENT MECHANISM, BACK COVER AND ARM REST FOR A CHAIR

(75) Inventor: Egon Bräuning, Weil am Rhein (DE)

(73) Assignee: Vitra Patente AG, Muttenz (CH)

( * ) Notice: Subject to any disclaimer, the term of this patent is extended or adjusted under 35 U.S.C. 154(b) by 0 days.

(21) Appl. No.: 09/581,889

(22) PCT Filed: Oct. 21, 1998

(86) PCT No.: PCT/IB98/01671

§ 371 (c)(1),
(2), (4) Date: Jun. 19, 2000

(87) PCT Pub. No.: WO00/22960

PCT Pub. Date: Apr. 27, 2000

(51) Int. Cl.[7] ..... A47C 1/02
(52) U.S. Cl. ..... 297/316; 297/300.2
(58) Field of Search ..... 297/316, 320, 297/300.1, 300.2, 300.3, 300.8, 301.6, 301.7, 300.7, 340, 313, 328

(56) References Cited

U.S. PATENT DOCUMENTS

| | | | | | |
|---|---|---|---|---|---|
| 4,521,053 | A | * | 6/1985 | De Boer | 297/312 |
| 4,640,547 | A | * | 2/1987 | Fromme | 297/316 X |
| 4,682,815 | A | * | 7/1987 | Steifensand | 297/313 X |
| 4,743,065 | A | * | 5/1988 | Meiller et al. | 297/300.1 X |
| 5,725,276 | A | * | 3/1998 | Ginat | 297/300.5 X |
| 5,899,530 | A | * | 5/1999 | Tedesco | 297/328 X |

FOREIGN PATENT DOCUMENTS

| | | |
|---|---|---|
| CH | 568738 | 11/1975 |
| CH | 582498 | 12/1976 |
| DE | 8616836 | 12/1987 |
| DE | 19607136 | 8/1996 |
| EP | 0815778 | 2/1998 |
| WO | 9524845 | 9/1995 |
| WO | 9816140 | 4/1998 |

* cited by examiner

*Primary Examiner*—Peter M. Cuomo
*Assistant Examiner*—Stephen Vu
(74) *Attorney, Agent, or Firm*—Selitto, Behr & Kim

(57) ABSTRACT

The adjustment mechanism contains a pneumatic spring that is placed vertically in the underframe, for adjusting height, and a pneumatic spring that is linked to the seat support at one end and the back-rest at the other, for synchronized adjustment of the angle. The pivotable back-rest and the fixed seat support are coupled with each other on the main rotational axis in two hinge connections. The main rotational axis runs above and crosswise over the seat plate. The seat plate has guide cranks on its underside, the supporting arms of the seat support engaging is said guide cranks in such a way that they can slide crosswise to the main rotational axis. The front bearing pegs of the supporting arms engage in the guide cranks. The seat plate is coupled together with the inclination spring on the moving rotational axis on the back-rest. The invention also relates to a back cover with a variably positionable lumbar reinforcement insert and height-adjustable armrests. The inventive adjustment mechanism offers efficient and comfortable synchronization between the sequences of movement of the back-rest and the seat plate.

9 Claims, 7 Drawing Sheets

ADJUSTMENT MECHANISM, BACK COVER AND ARM REST FOR A CHAIR

FIELD OF APPLICATION OF THE INVENTION

Figure 1B:
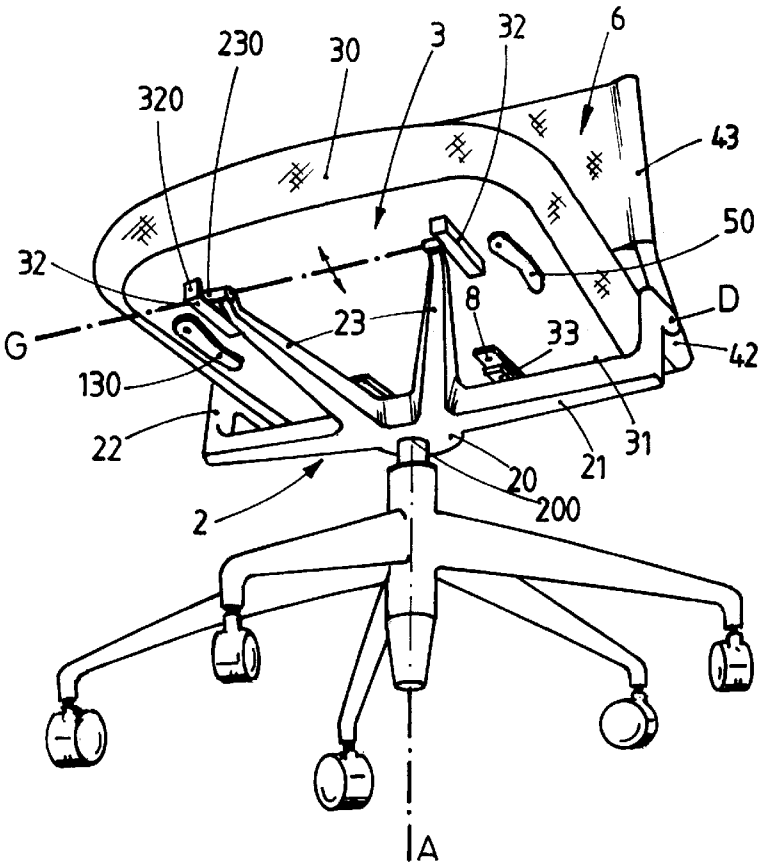

The subject matter of the present invention is a chair, in particular an office swivel chair, having a height-adjustable seat surface and an inclination-adjustable back part, a synchronous change in the position of the seat surface taking place with the adjustment of the back part. The chair has a pivot axis which runs over the width of the seat surface and is formed by joint connections on the seat support. The entire chair mechanism is arranged below the seat plate. The height and inclination are adjusted by means of springs, preferably pneumatic springs. In order to optimize the kinematics of the inclination and to set a prestress which overrides the pneumatic spring, it is customary to provide an additional helical compression spring. The pneumatic springs are actuated by adjusting levers which are arranged below the seat plate and to which the user in the seat has convenient access. If the locking of the inclination adjustment is released, the user can get from the vertical position into the inclination position by shifting his weight, the seat plate following the adjustment. Chairs of this type offer the user increased comfort, since the back part and the seat surface are advantageously matched ergonomically to the seat position assumed in each case.

The invention is furthermore concerned with a cover for the back part and also with a height-adjustable armrest.

PRIOR ART

CH-A-568 738 discloses the principle of subdividing the seat surface into a fixed thigh support and a pivotable posterior support which merges into the backrest. The subdivision is realized using hinge elements which are arranged in the side parts of the supporting frame.

CH-A-582 498 likewise proposes a chair having a pivotable backrest and a posterior support connected to it, the cover of the seat surface extending beyond the pivot axis as far as the rear part of the frame. A pneumatic spring is used for adjusting the inclination. However, it does not have a height-setting capability or an integrated adjusting mechanism.

WO-A-98/16140 discloses a chair having a pivotable back part whose rotational axis defines a rear region on the seat surface having a posterior support. One section of the back part extends as far as the rotational axis where the back part is coupled to the seat support in a hinge connection. A one-piece cushion cover is fastened to the seat support and runs from the seat surface over and beyond the rotational axis as far as the frame part behind the posterior support. The back part is composed of the back support which is coupled in the hinge connection, and of a bow-shaped back tensioner which is to be fixed over it and is inserted into the back part of the cushion cover. The cushion cover stretches as one piece over the seat surface and the back part. The back support has a transverse strut to which the cushion cover is fastened and from where it passes onto the back part. When the backrest is inclined, the seat surface is virtually stationary and only the posterior support as a cushion section follows a changed inclination, so that a complete synchronous sequence between the back part and seat surface is not realized. In addition, this chair does not have armrests.

OBJECT OF THE INVENTION

The invention is therefore based on the object of realizing, for a chair having a pivot axis running over the seat surface, the full synchronous sequence between the pivoting movement of the back part and the seat surface. The chair mechanism is to be as uncomplicated as possible in its basic structure, and to be functionally reliable, not to need much servicing and to be convenient to operate. Furthermore, the mechanism is to be integrated inconspicuously in the chair as a compact construction. The back cover is to provide good support for the lumbar region of the user. In addition, the chair has to be fitted with height-adjustable armrests which can be adjusted conveniently and nevertheless have great stability in the setting selected. Finally, the chair is to be able to be produced in series efficiently and cost-effectively and at the same time make an original aesthetic appearance possible.

SUMMARY OF THE INVENTION

The adjusting mechanism is designed for a chair seat which is placed onto an underframe which is known per se and has a vertically inserted pneumatic spring for adjusting the height. In this case, the seat support, which is arranged right at the bottom of the seat, is placed onto the telescopically extendable piston rod of the pneumatic spring. The seat support supports a seat plate, and a pivotable back support is coupled on a main rotational axis which runs transversely above the seat plate, parallel to its front edge. An inclination spring is coupled at one end to the seat support on a fixed rotational axis and at the other end to the back support on a moving rotational axis. On its lower side the seat plate has guide cranks in which supporting arms of the seat support engage in a manner such that they can be displaced transverse to the main rotational axis. The seat plate is coupled to the back support, together with the inclination spring, on the moving rotational axis. Two spaced apart guide cranks are advantageously provided in the vicinity of the front edge of the seat plate, the guide cranks having an end limitation at the front as a stop. Bearing pegs which are arranged right at the front of the free ends of the supporting arms engage in the guide cranks.

Two arms of the back support, which arms extend laterally above the seat plate, and, in principle, two vertical branches—these constitute angled extensions of transverse extension arms, running below the seat plate, of the seat support are connected to one another in an articulated manner in the main rotational axis. The branches each have a plug-in opening for receiving an armrest. The back support has a transverse strut which extends between the arms, parallel to the main rotational axis, and has two stays which run upward from the intersection of the transverse strut with the respective arm. Fastened to the transverse strut is an axial bar through which runs the moveable rotational axis with the hinged seat plate and the hinged inclination spring. A pneumatic spring with an attached helical spring is especially suitable as the inclination spring. A back cover is stretched between the arms, it being possible for a curved back tensioner to be attached to the arms, so that the arms are only of stump-shaped design.

A respective hinge plate is coupled to the axial rod on both sides of the hinged inclination spring, and the seat plate is fastened on the hinge plates at a variable distance from the rotational axis. A ball socket for holding a release ball is situated in the seat support, it being possible for said release ball to be moved via a cable pull and an operating lever against the valve rod of the pneumatic inclination spring, as a result of which the locking of the pneumatic inclination spring—as an open connection—is cancelled.

A lumbar reinforcing insert—in the form of a flexible plate—which is height-displaceable and can be fixed at the height selected is arranged in the back cover. An upwardly protruding fixing tongue extends from the plate. The reinforcing insert is inserted into an upwardly open pocket which is incorporated in the back cover. On the fixing tongue which protrudes out of the back cover through a slot and on the back cover, fixing components, for example touch and close fasteners, for the releasable fastening are provided. In this manner, the selected height position of the lumbar reinforcing insert can be retained. On its lower edge the back cover is fixed on the rear side of the transverse strut. This advantageously takes place using fastening elements which protrude through the transverse strut and with which the axial rod is at the same time fastened to the transverse strut. The armrest has an approximately vertical stay with an arm support arranged at the top, a notched section having a systematic grid of notches being provided on the stay. The notches lie in a line one above another and are semicircular. The notched section is plugged into the plug-in opening in the raised branch of the seat support. A hole which the inserted notched section partially touches is made in this branch. Seated in the hole is an operating button which is supported by a spring and engages in a locking manner in the contour of a notch standing in position with respect to the operating button. The cross section of the stay is preferably elliptical, the notches lying on a main apex of the ellipse. The operating button is connected axially to a disk element of which a circular segment engages in the positioned notch.

The essential advantages of the adjusting mechanism reside in the efficiently and comfortably realized synchronization between the sequences of movement of the back support and seat plate. The chair is refined by means of height-adjustable armrests, the adjustment being easy to operate for the user and positions which are set being retained stably, even when subjected to a relatively great load. The lumbar reinforcing insert which can be inserted in a height-variable manner into the back cover provides an individually and rapidly positionable support for the lumbar region of the user.

DRAWINGS AND EXEMPLARY EMBODIMENT

Figure 1A:
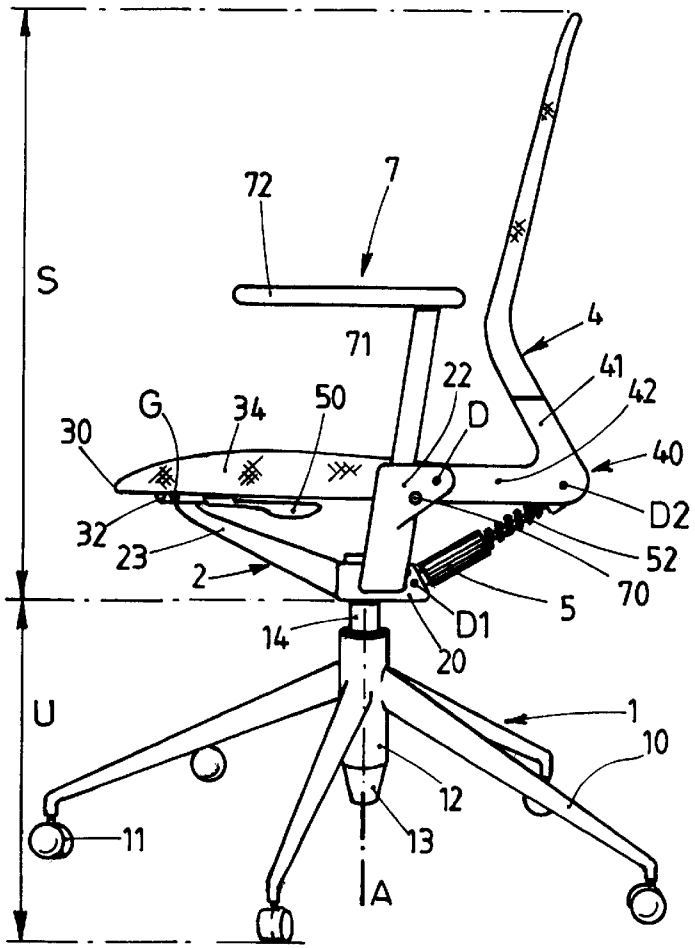
Figure 2A:
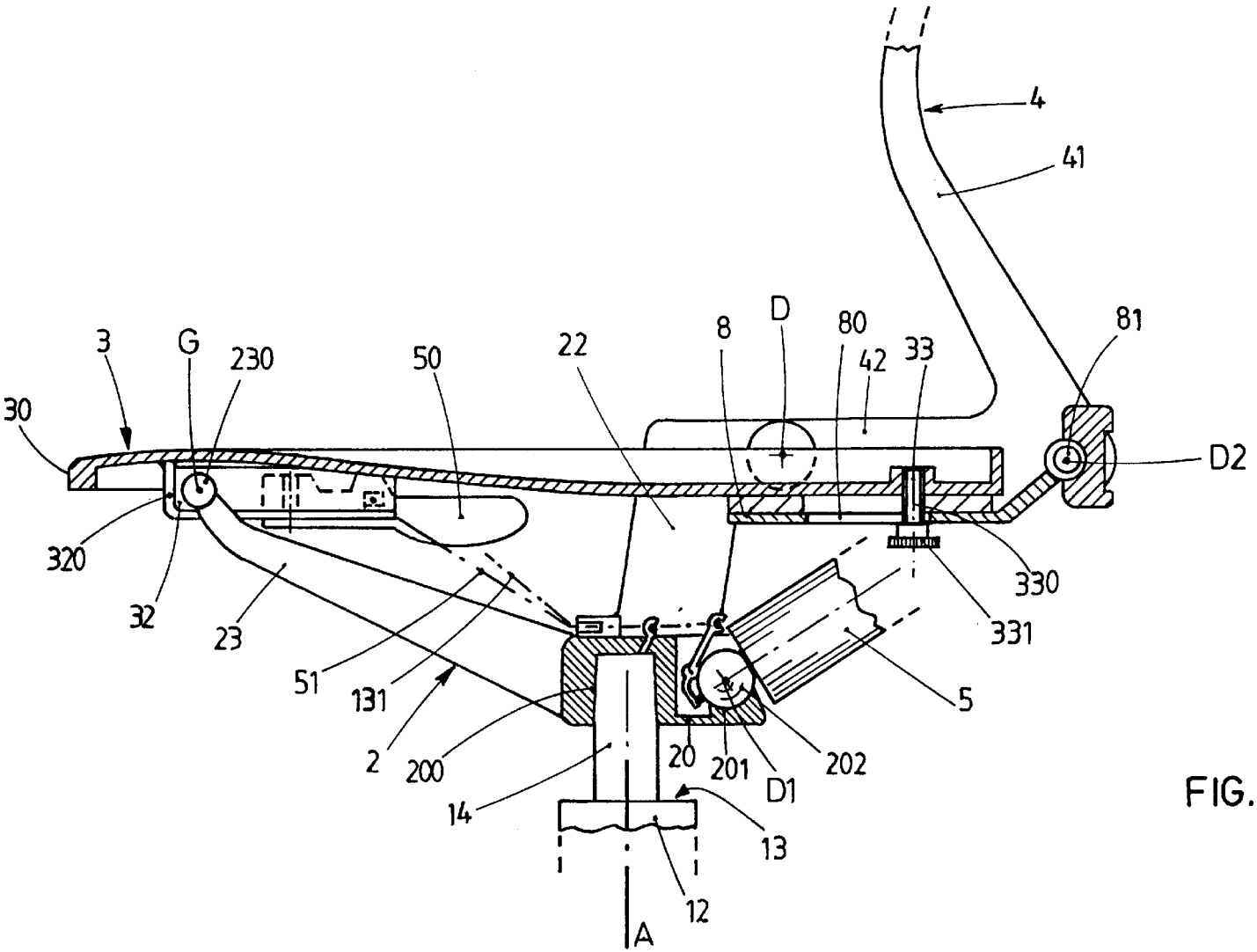
Figure 2B:
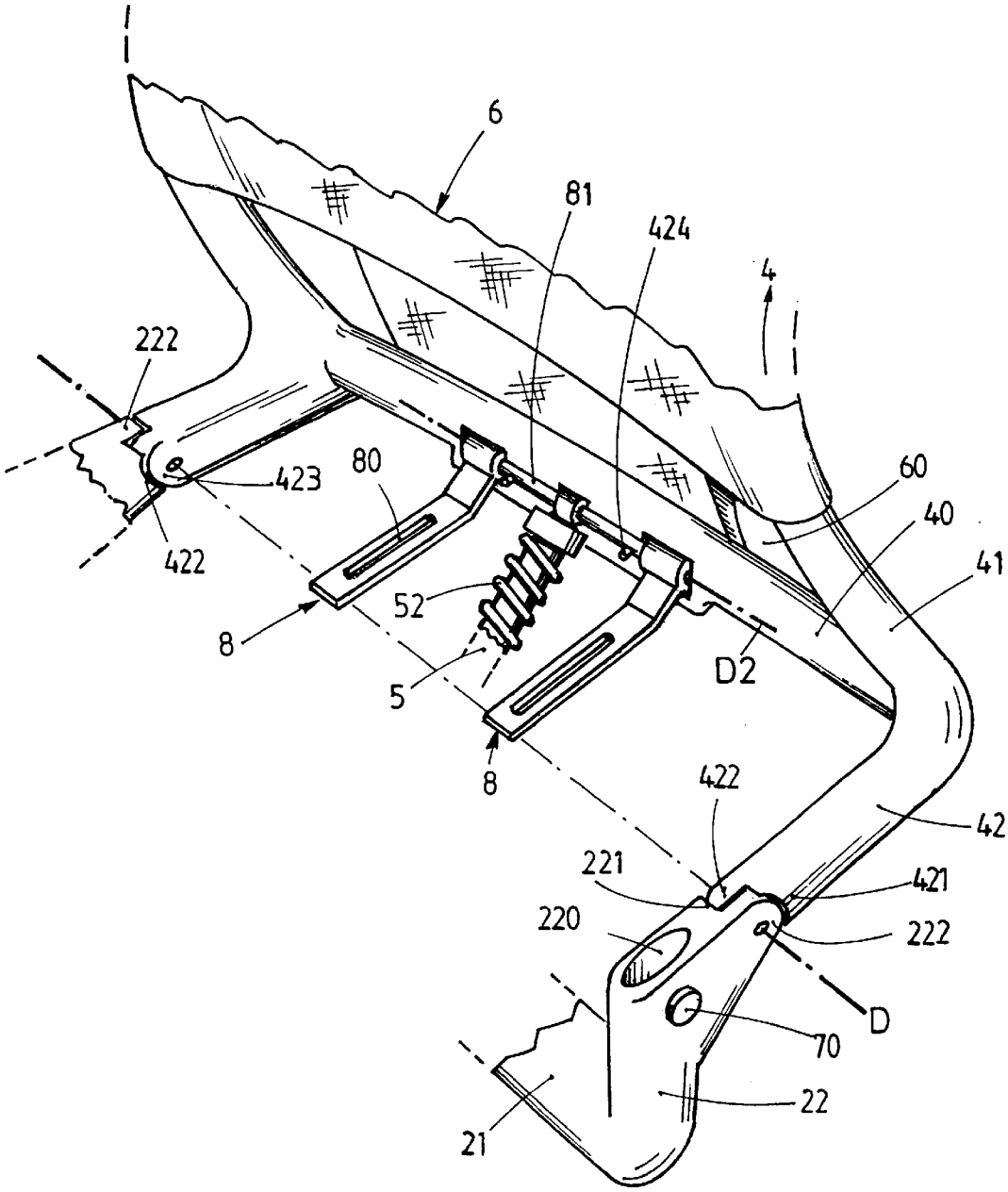
Figure 3B:
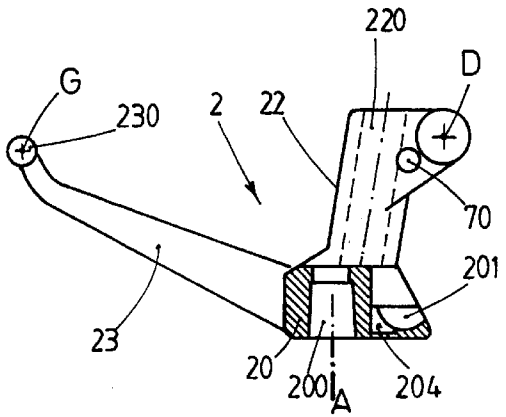
Figure 3A:
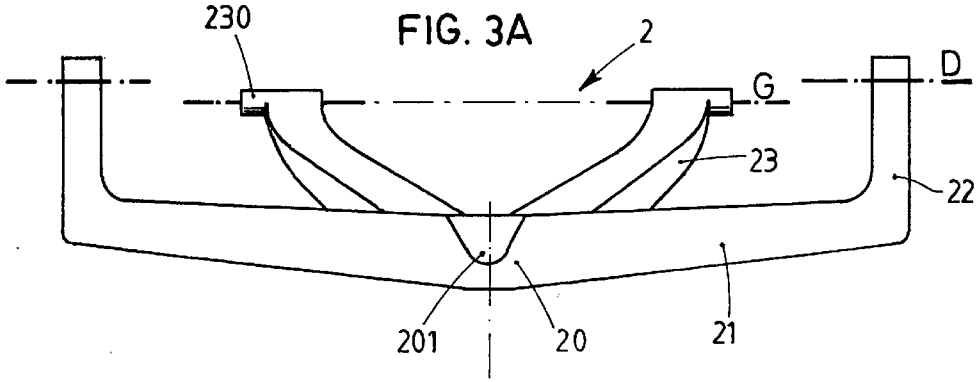
Figure 3C:
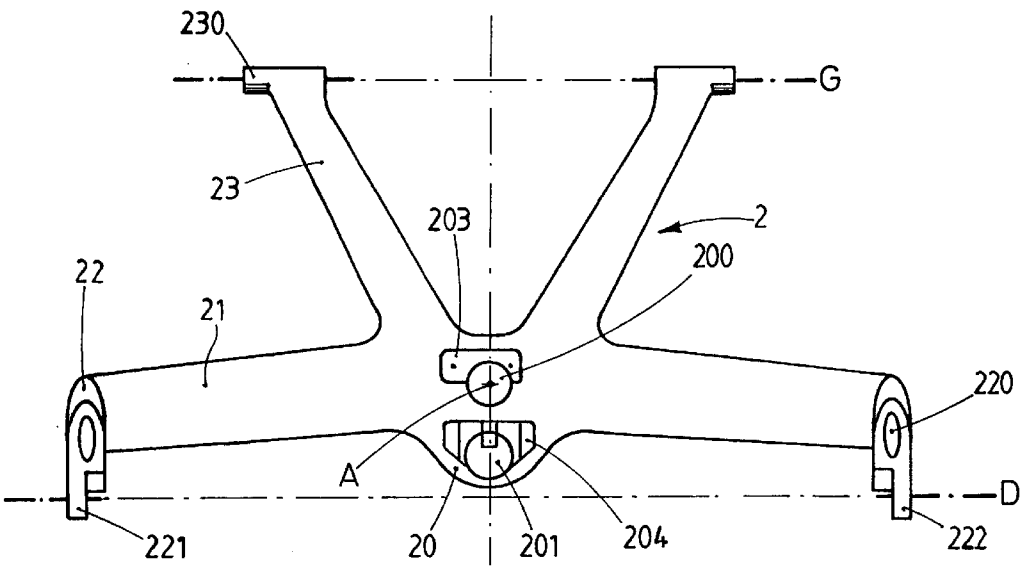
Figure 4:
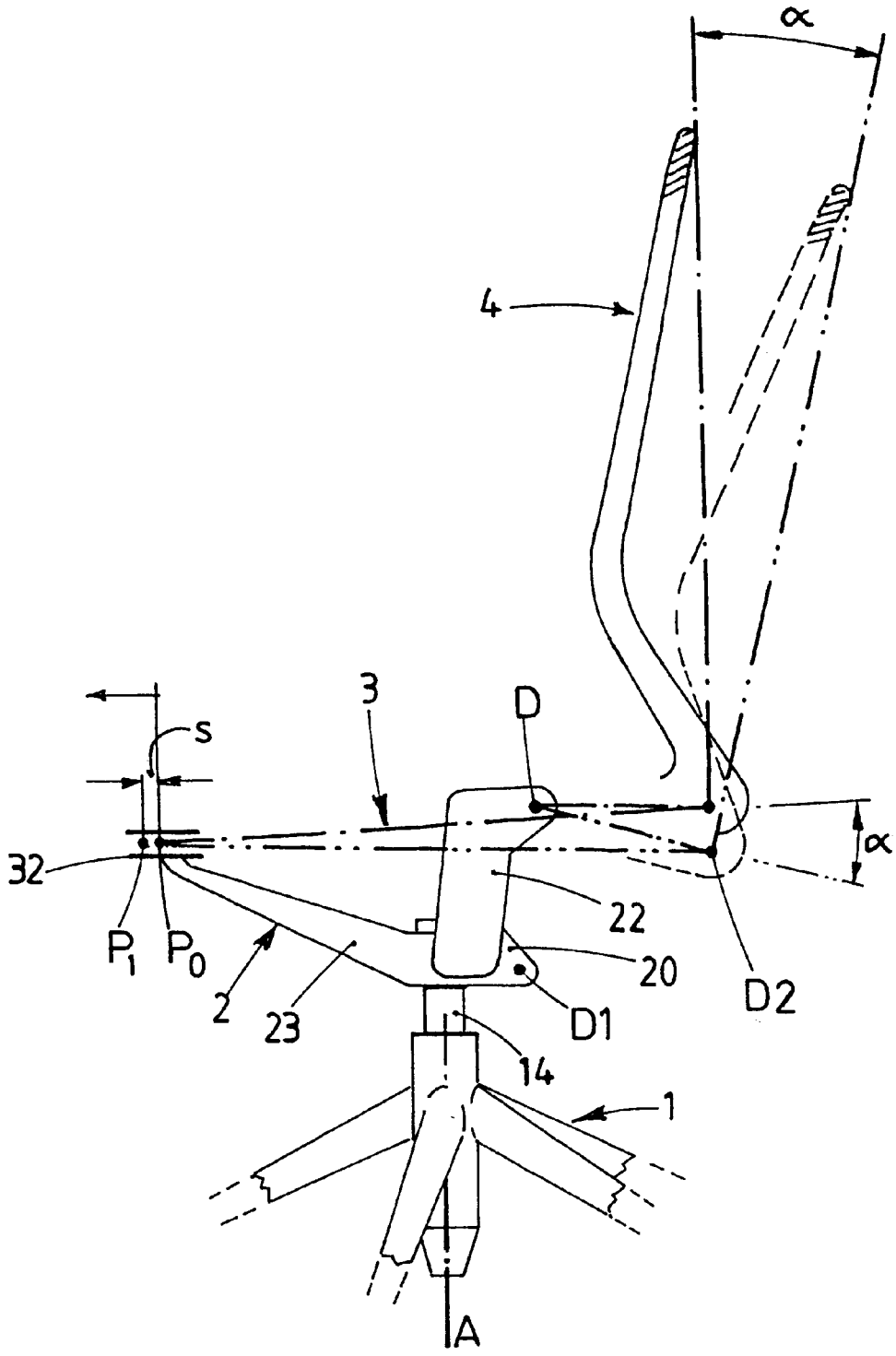
Figure 5A:
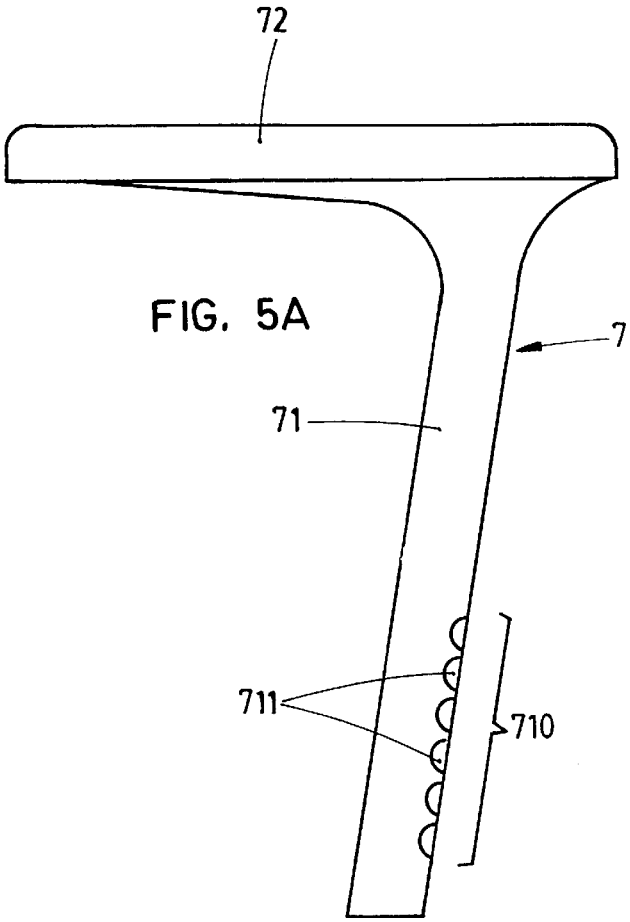
Figure 5B:
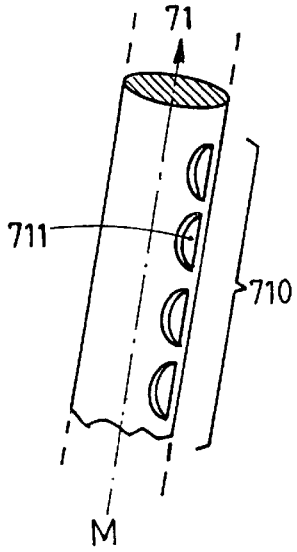
Figure 5C:
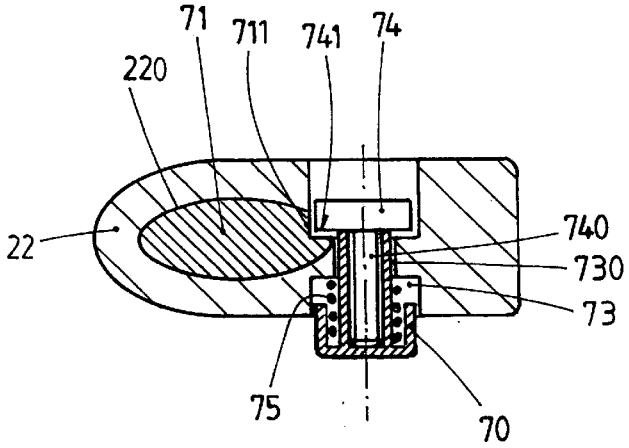
Figure 6A:
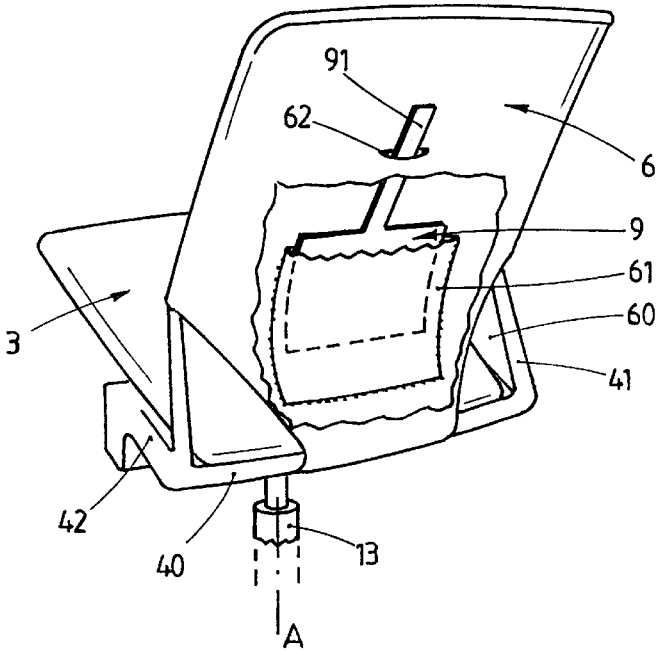
Figure 6B:
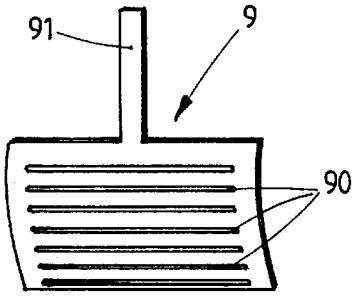

The detailed description of exemplary embodiments regarding the adjusting mechanism according to the invention, the back cover and the armrest is given below with reference to the attached drawings, in which:

FIG. 1A: shows an entire chair in a side view;

FIG. 1B: shows the chair according to FIG. 1A from below in a perspective view;

FIG. 2A: shows a seat support together with a hinged back support and the pneumatic inclination spring as a partial section in a side view;

FIG. 2B: shows the hinged back support together with the seat-plate supporting means in a perspective view;

FIG. 3A: shows the seat support from the rear;

FIG. 3B: shows the seat support according to FIG. 3A as a partial section in a side view;

FIG. 3C: shows the seat support according to FIG. 3A in plan view;

FIG. 4: shows the sequence of movement of the chair between the vertical position and inclination position as a basic illustration;

FIG. 5A: shows an individual armrest;

FIG. 5B: shows a section of the stay of the armrest according to FIG. 5A together with the latching notches on an enlarged scale;

FIG. 5C: shows the locking mechanism on the armrest according to FIG. 5A in horizontal section;

FIG. 6A: shows the back cover cut open with an inserted lumbar reinforcing insert, in a perspective view of the rear side of the chair;

FIG. 6B: shows the lumbar reinforcing insert from FIG. 6A; and

Figure 6C:
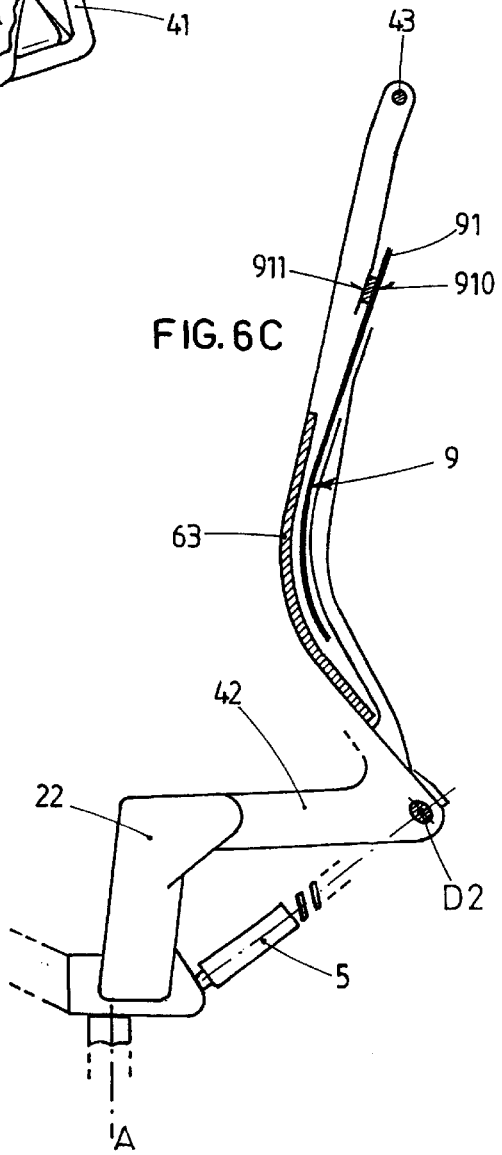

FIG. 6C: shows the back cover with the inserted lumbar reinforcing insert according to FIG. 6A as a partial section in a side view.

FIGS. 1A AND 1B

The entire chair is divided into two planes, the underframe U which is known per se and the seat S which is placed onto the underframe U and contains the invention. The underframe U consists of a typical star-shaped base 1 having five arms and castors 11 which are attached to the ends of the arms 10 and are placed onto the floor. The center of the star-shaped base 1 is formed by a sleeve piece 12 in which a vertical pneumatic spring 13 is inserted vertically. Protruding out of the vertical pneumatic spring 13, on the axis A, is a telescopically extendable piston rod 14 onto which the seat support 2, which constitutes the base part of the entire seat S, is placed. The seat S can be rotated about the axis A and can also be adjusted in height by extension and retraction of the piston rod 14 on the axis A. In addition to the seat support 2, the seat S includes a seat plate 3 with a seat cushion 34 attached, a back support 4, a pneumatic inclination spring 5 with a helical spring 52 pushed onto its piston rod, a back cover 6 and two armrests 7.

The pneumatic inclination spring 5, which is arranged such that it rises obliquely, is coupled to the rear base section 20 of the seat support 2 in the horizontal rotational axis D1. At the other end, the pneumatic inclination spring 5 is coupled to the transverse strut 40 of the back support 4 in the horizontal moving rotational axis D2. Extending outward from the transverse strut 40 are, rising, two vertical stays 41 and the two horizontal arms 42 branching off at right angles virtually forward—toward the front edge 30 of the seat plate 3. Right at the front, the arms 42 are connected in hinge form to the seat support 2, resulting in the formation here of the main rotational axis D about which the back support 4 can be pivoted in its entirety. A bow-shaped back tensioner 43 which is covered by the back cover 6 is upwardly attached to the two vertical stays 41.

The solid seat support 2, which in principle has four arms, has the rear base section 20 with the hole 200 into which the piston rod 14 of the vertical pneumatic spring 13 is plugged. A respective transverse extension arm 21 extends from the base section 20 to both sides, horizontally and parallel to the main rotational axis D. At the ends, the transverse extension arms 21 continue with an upwardly angled branch 22 into which the lower, free ends of the stays 71 of the armrests 7 are plugged and through which the main rotational axis D with the hinged back support 4 extends. The height position of the armrests 7 can be fixed using an operating button 70 which is accessible at the side of the branch 22. The stays 71 extend upward from the branch 22 to the horizontally arranged arm support 72. Two supporting arms 23 which lead toward the front edge 30 of the seat plate 3 likewise branch off from the base section 20, between the two transverse extension arms 21.

Arranged on the lower side of the seat plate 3 are two spaced apart guide cranks 32 which run toward the front edge 30 of the seat plate. At the front, in the vicinity of the front edge 30, the guide cranks 32 end with an end limitation 320. The free ends of the supporting arms 23, on which bearing pegs 230 are situated, engage in the guide cranks 32. Also attached to the lower side of the seat plate 3 are the operating levers 130,50 which can easily be reached by the seat user with his hands and are for actuating the vertical pneumatic spring 13 and the pneumatic inclination spring 5. Finally, two spaced apart, releasable fastening elements 33—for example, screws—protrude out of the lower side of the seat plate 3, in the vicinity of its rear edge 31. By means of these fastening elements 33 the seat plate 3, which rests on two hinge plates 8, can be fixed at an adjustable distance from the transverse strut 40 of the back support 4. When the distance is relatively short, the bearing pegs 230 of the supporting arms 23 move further into the guide cranks 32, i.e. in the direction of their limitation 320. This enables the seat depth to be matched to the individual user's requirements. The alignment of the two bearing pegs 230 produces the horizontal sliding axis G. The hinge plates 8 are, like the pneumatic inclination spring 5, coupled to the transverse strut 40.

FIGS. 2A AND 2B

In the illustration shown, the seat plate 3 is fixed maximally in the direction of the back support 4. The bearing pegs 230 of the seat support 2 are situated in their furthest forward position, directly in front of the end limitations 320 of the guide cranks 32, while the fastening elements 33 are positioned against the rear stop in the longitudinal slots 80 in the hinge plates 8. The hinge plates 8 are fastened pivotably together with the pneumatic inclination spring 5 on the horizontal moving rotational axis D2. The moving rotational axis D2 is formed by an axial bar 81 which is fastened in a fixed manner along the transverse strut 40, the pneumatic inclination spring 5 being arranged between the two hinge plates 8 and the moving rotational axis D2 lying parallel to the main rotational axis D. The axial bar 81 is partially embedded in the transverse strut 40. A fastening element 33 consists preferably of a threaded bolt 330 which protrude out of the lower side of the seat plate 3, and of a nut 331 which can be screwed on from below against the hinge plate 8. The threaded bolt 330 is inserted fixedly in the seat plate 3 and protrudes through a longitudinal slot 80 in the hinge plate 8, so that the latter can be fixed in a manner which allows it to be displaced over the extent of the longitudinal slot 80, and the position of the sliding axis G is thereby set. Bowden cables 131,51 run from the operating levers 130,50 in order to actuate the vertical pneumatic spring 13 and pneumatic inclination spring 5. The valve rod for triggering the pneumatic inclination spring 5 faces the base section 20 of the seat support 2. Inserted into the base section 20 is a ball socket 201 in which a bearing ball 202 is situated on the fixed rotational axis D1 as a support for the pneumatic inclination spring 5. A continuation of the valve rod of the pneumatic inclination spring 5 extends through the bearing ball 202. On this continuation is a control element which is connected via a Bowden cable to the associated operating lever 50. When the operating lever 50 is actuated, the control element moves the valve rod of the pneumatic inclination spring 5, which therefore comes into the open position. If no body pressure is exerted on the back support 4, the piston rod extends and the back support 4 is raised until it reaches the vertical position. If body pressure is exerted on the back support 4—the pneumatic inclination spring 5 is not yet maximally retracted—the back support 4 can be pressed into its maximum inclination position.

In the branch 22 there is situated an upwardly accessible plug-in opening 220 for receiving the lower notched section 710 (see FIGS. 5A and 5B) of the stay 71 of the height-adjustable arm rest 7 which can be plugged in. The operating button 70 for locking the height of the armrest 7 lies on the outer wall of the branch 22 and is aligned tangentially past the plug-in opening 220. The joint connection on the main rotational axis D between the branch 22 and the arm 42 running toward it is formed by a respective cutout 221,421 of half material thickness, so that the pegs 222,422 which are produced and which are rounded at the front engage in the respectively opposite cutout 421,221. A firmly fitting axial pin 423 extends on the main rotational axis D through the pegs 222,422 lying against each other. The back cover 6 is pulled over the length of the axial bar 81 as far as the rear side of the transverse strut 40 and is fixed there by means of fastening elements 424—for example, screws—which pass through the axial pin 423. In the corner region where the transverse strut 40, the vertical stay 41 and the arm 42 come together, the back cover 6 has a cutout 60.

FIGS. 3A TO 3C

There can be seen in the base section 20 the hole 200 for receiving the piston rod 14 of the vertical pneumatic spring 13, next to the hole 200 the guides 203 for the Bowden cables 51,131, and further to the rear the ball socket 201 for receiving the bearing ball 202 for the pneumatic inclination spring 5, and next to the ball socket 201 a cutout 204 for the incoming Bowden cable 51. Seen on the branch 22 are the plug-in opening 220 going into it, the operating button 70 and the pegs 222, which are placed on the main rotational axis D, and the respectively associated cutouts 221. The supporting arms 23 exhibit at the front the bearing pegs 230 which protrude to the side.

FIG. 4

The behavior of the back support 4 and seat plate 3 during the rearward inclination of the back support 4 is considered.

The seat plate 3 is fixed in a defined position by means of the fastening elements 33. In the vertical position of the back support 4, the sliding axis G is situated within the guide cranks 32 at the position $P_0$, i.e. relatively far away from the end limitations 320, and the seat plate 3 is in its normal position.

If the back support 4 is then moved rearward by the maximally possible adjusting angle α about the main rotational axis D into the inclination position, the distance between the moving rotational axis D2 and the original position $P_0$ is shortened. Since the seat plate 3 hangs in a transversely displaceable manner with respect to the main rotational axis D by the guide cranks 32 on the bearing pegs 230 of the supporting arms 23 of the seat support 2, the seat plate 3 is pushed in the direction of the front edge 30. The sliding axis G is shifted to the position Pi by the distance s. At the same time, the seat plate 3 is clearly lowered at the rear edge 31, while a proportional, relatively small lifting takes place at the front edge 30. There is therefore a synchronous sequence of movement between the back support 4 and seat plate 3.

FIGS. 5A TO 5C

The armrest 7 has the approximately vertical support 71 to which the approximately horizontal arm support 72 is fastened at the top. At the bottom, the stay 71, which is in principle elliptical, has a notched section 710 with a systematic grid of notches comprising uniformly spaced, semicircular notches 711 which lie one above another on a main apex in accordance with geometrical theory. The rounded portions of the notches 711 point toward the central axis M of the stay 71. A hole 73, which is aligned tangentially past the plug-in opening 220 and has a constriction 730 internally, is provided in the rising branch 22 of the seat support 2. A spring-loaded operating button 70, which is designed as a push button, is inserted from the one side of the hole; inserted from the other side is a disk element 74 whose shaft 740, which is reduced in diameter, protrudes through the constriction 730 and is connected fixedly to the operating button 70. A helical spring 75 attempts to press the operating button 70 outward and as it does so pulls the disk element 74 into the hole 73. Here, a circular segment 741 of the disk element 74 engages in the notch 711 which is positioned at the level of the operating button 70. The armrest 7 is therefore fixed at the extended height. To release it, the operating button 70 has to be pressed in counter to the action of the helical spring 75, so that the disk element 74 and the notch 711 which is close to it are disengaged. The armrest 7 can then be adjusted in its height until a notch 711 corresponding to the desired height is occupied by the disk element 74.

FIGS. 6A TO 6C

In the lumbar region the back cover 6 has an internal, upwardly open pocket 61 into which a plate-shaped lumbar reinforcing insert 9 is inserted. The reinforcing insert 9 has transversely running elastic slots 90 and also an upwardly protruding fixing tongue 91. This fixing tongue 91 protrudes through a slot 62 in the back cover 6 on the rear side of the chair, the slot 62 lying above the pocket 61. On the front side, toward the user, the back cover has padding 63.

If it is desired to adjust the height position of the reinforcing insert 9, the fixing tongue 91 is detached from the back cover 6 and the reinforcing insert 9 is pushed further into the pocket 61 or pulled out of it. To fix the fixing tongue 91 at the selected height it is appropriate to provide its rear side with a first layer 910 of a touch and close fastening, and to attach the complementary, second layer 911 of the touch and close fastening on the back cover 6, opposite the first layer 910. The lower ends of the back cover 6 are fixed on the rear side of the transverse strut 40.

I claim:

1. A combination of an adjusting mechanism and a chair comprising said chair having an underframe with a base which is placed onto the ground and with a pneumatic spring which is inserted in said underframe along a vertical axis and has a telescopically extendable piston rod for setting the height of said chair, and a seat with a seat support at the bottom thereof and which is positioned on said piston rod; wherein, further said adjusting mechanism comprising:

a seat plate which is supported by said seat support and has a front edge;

a pivotable back support pivotably attached directly to said seat support along a main rotational axis which is transverse to and above said seat plate and parallel to said front edge of said seat plate; and an inclination spring which is affixed at one end to said seat support on a fixed rotational axis and at an opposite end to said back support on a moving rotational axis, wherein:

said seat plate has a lower side with guide cranks and said seat support has supporting arms, which engage in said guide cranks such that said supporting arms are displaceable in a direction transverse to said main rotational axis; and said seat plate is affixed to said back support on said moving rotational axis;

said back support includes two arms which are connected to one another in an articulated manner and which extend laterally from either side of said back support and above said seat plate;

said seat support has at least two transverse extension arms extending in opposite directions therefrom and below said seat plate, each of said at least two transverse extension arms having a branch extending upwardly therefrom; and each of said two arms of said back support is connected in an articulated manner, along said main rotational axis, to a respective one of said branches of said at least two transverse extension arms.

2. The combination as claimed in claim 1, wherein two spaced apart guide cranks are provided proximate to said front edge of said seat plate;

each of said guide cranks has a front end with an end limitation; and each of said supporting arms includes a free end with a bearing peg which engages in a respective one of said guide cranks.

3. The combination as claimed in claim 1, wherein:

each of said branches of said at least two transverse extension arms is angled vertically;

said vertical branch of each of said at least two extension arms having a plug-in opening for receiving an armrest therein.

4. The combination as claimed in claim 3, wherein said armrest includes a substantially vertical stay with a top portion having an arm support positioned thereon;

a notched section provided on said vertical stay and having a systematic grid of semicircular notches positioned one above another; wherein said notched section is plugged into said plug-in opening in said vertical branch of one of said two transverse extension arms of said seat support; and said vertical branch of one of said two transverse extension arms has a hole that communicates with said plug-in opening and an operating button positioned in said hole, said operating button being stressed by a spring and lockingly engaging one of said semicircular notches that is proximate to said hole when said notched section of said vertical stay of said armrest is plugged into said plug-in opening.

5. The combination as claimed in claim 3, wherein said back support includes a transverse strut that is connected by one end to one of said two arms, thereby forming an intersection, and is connected by an opposite end to the other of said two arms, thereby forming another intersection, said transverse strut being parallel to said main rotational axis;

said back support includes two stays, each of which extends upwardly from a corresponding one of said intersections of said transverse strut with said two arms;

an axial bar is fastened to said transverse strut, said moving rotational axis extending through said axial bar and said transverse strut, said seat plate and said inclination spring each being hingedly connected to said axial bar; and a back cover is stretched between said two arms.

6. The combination as claimed in claim 5, wherein two hinge plates are attached to said axial bar, one of said two hinge plates being attached to said axial bar on one side of said inclination spring and the other of said two hinge plates being attached to said axial bar on the opposite side of said inclination spring; and said seat plate is fastened to said hinge plates at any one of a plurality of distances from said moving rotational axis.

7. The combination as claimed in claim 5, wherein a ball socket for holding a bearing ball is provided in said seat support;

said bearing ball serves as a support for said inclination spring on said fixed rotational axis;

said inclination spring includes a valve rod having a continuation that extends through said bearing ball; and said continuation includes a control element which is connected to a corresponding operating lever for cancelling the locking of said inclination spring.

8. The combination as claimed in claim 5, wherein said inclination spring is a pneumatic spring with an attached helical spring.

9. The combination as claimed in claim 5, wherein said back cover is pulled onto said back support and includes a lumbar reinforcing insert which is height-displaceable and fixable at any one of a plurality of predetermined heights.

* * * * *